United States Patent [19]

Hasegawa et al.

[11] Patent Number: 4,973,236

[45] Date of Patent: Nov. 27, 1990

[54] APPARATUS FOR MELT-SPINNING THERMOPLASTIC POLYMER FIBERS

[75] Inventors: Katsumi Hasegawa; Michio Ohno, both of Kusatsu; Isoo Saito, Okazaki; Kotaro Fujioka, Nagoya, all of Japan

[73] Assignee: Toray Industries, Inc., Tokyo, Japan

[21] Appl. No.: 333,607

[22] Filed: Apr. 4, 1989

Related U.S. Application Data

[60] Division of Ser. No. 226,383, Jul. 29, 1988, Pat. No. 4,863,662, which is a continuation of Ser. No. 883,869, Jul. 14, 1986, abandoned, which is a continuation of Ser. No. 685,126, Dec. 21, 1984, abandoned.

[30] Foreign Application Priority Data

Dec. 22, 1983 [JP] Japan ..... 58-242662

[51] Int. Cl.[5] ..... B29C 47/00; D01D 5/092

[52] U.S. Cl. ..... 425/72.2; 264/210.8; 264/211.14

[58] Field of Search ..... 425/72.2; 264/210.7, 264/210.8, 237, 177.13, 210.1–210.3, 211.14, 211.13

[56] References Cited

U.S. PATENT DOCUMENTS

| | | | |
|---|---|---|---|
| 2,252,684 | 8/1941 | Babcock | 425/72.2 |
| 2,451,854 | 10/1948 | Mehler | 425/72.2 |
| 3,707,593 | 12/1972 | Fukada et al. | 425/72.2 |
| 4,049,763 | 9/1977 | Mineo et al. | 264/210.8 |
| 4,303,607 | 12/1981 | DeMaria et al. | 264/210.7 |
| 4,491,657 | 1/1985 | Saito et al. | 264/210.8 |
| 4,780,073 | 10/1988 | Katsumi et al. | 425/72.2 |

FOREIGN PATENT DOCUMENTS

| | | | |
|---|---|---|---|
| 2349832 | 4/1975 | Fed. Rep. of Germany | 264/237 |
| 55-71807 | 5/1980 | Japan | 264/237 |
| 827628 | 5/1981 | U.S.S.R. | 264/237 |
| 848486 | 7/1981 | U.S.S.R. | 264/237 |

*Primary Examiner*—Jay H. Woo
*Assistant Examiner*—James P. Mackey
*Attorney, Agent, or Firm*—Austin R. Miller

[57] ABSTRACT

A thermoplastic polymer yarn is spun into a spinning tube charged with a pressurized gas of more than 1 kg/cm$^2$G and withdrawn through a yarn exit provided with a unique sealing device which substantially prevents the charged gas from leakage but allows passage of the yarn out from the spinning tube. The resultant yarn has a high molecular orientation due to the improved quenching effect and the increase of resistance against yarn travelling of the charged gas.

14 Claims, 10 Drawing Sheets

APPARATUS FOR MELT-SPINNING THERMOPLASTIC POLYMER FIBERS

RELATED APPLICATIONS

This application is a division of application Ser. No. 226,383, filed July 29, 1988, now U.S. Pat. No. 4,863,662, granted Sept. 5, 1983, which is a continuation of application Ser. No. 883,869, filed July 14, 1986 and now abandoned, which in turn was a continuation of application Ser. No. 685,126, filed Dec. 21, 1984, now abandoned.

BACKGROUND OF THE INVENTION

1. Field of the Invention

The present invention relates to an apparatus for melt-spinning thermoplastic polymer fibers having high molecular orientation by extruding a fiber-forming polymer into a pressurized atmosphere and then taking it up under normal atmospheric conditions.

2. Description of Related Art

For obtaining a well-oriented fiber by the ordinary melt-spinning system, in which a thermoplastic polymer is melted, spun through a spinneret, and taken up at a constant speed after being quenched and oiled, the melt-spinning operation is preferably carried out under a high take-up speed. The increase of the take-up speed is the most effective for this purpose and the control thereof is easier than with other factors influencing the molecular orientation of the resultant fiber, such as the polymerization degree of the polymer, melting temperature, draft ratio, extrusion rate of the polymer per nozzle hole, or quenching conditions.

Of course, by properly determining, the melting temperature, draft ratio, quenching conditions, and other spinning conditions, the degree of molecular orientation in the resultant fiber can be further improved. For example, a higher melting temperature, larger draft ratio, and rapid quenching speed may result in highly oriented fibers. In such spinning, however, the conditions are critical if one wishes to have a useful yarn having high uniformity and properties necessary for practical use. Further, control is very difficult.

There have been proposed, in Japanese Examined Patent Publication (Kokoku) Nos. 47-32130 and 47-33736, a method for spinning a molten polymer at a high spinning speed from a spinneret into a pressurized chamber disposed directly beneath the spinneret. In the chamber, the polymer is quenched to form fibers. Thereafter, it is ejected as a fully drawn fiber out from the chamber through a nozzle provided on the bottom of the chamber together with a flow of high pressure gas. This method aims to obtain a fully drawn fiber utilized as a material for making a non-woven fabric or web. The method, however, has a drawback that the control of yarn processing factors, such as yarn take-up speed, drawing force, or draw ratio is very difficult because the yarn is propelled mainly by a dragging force of the jet air.

Another method for spinning a polymer under a highly pressurized atmosphere has been proposed in Japanese Unexamined Patent Publication (Kokai) No. 50-71922, in which a yarn extruded from a spinneret is quenched under normal atmospheric pressure until just before it has reached a fully solidified state and then is taken up through a chamber pressurized above 0.1 kg/cm$^2$G. (Throughout this specification "G" has its conventional meaning of "gage" which means the pressure above atmospheric pressure as read on a gage.) According to this method, however, sealing means for the yarn inlet and exit of the chamber are necessary. Particularly, in the area of the inlet, non-touch sealing is required because the yarn passing thereby is not yet fully solidified. Thus, the cross-section of the inlet must be large, whereby the sealing effect tends to be lowered. As a result, as described in the above publication, the interior pressure of the chamber can be elevated only to 0.7 kg/cm$^2$G. Under such a low pressure, high molecular orientation of the resultant yarn cannot be expected.

SUMMARY OF THE INVENTION

It is a primary object of the present invention to eliminate the above drawbacks of the prior art.

It is another object of the present invention to provide a novel method and apparatus for producing a highly oriented yarn of thermoplastic polymer through a spinning chamber kept at a high pressure of at least 1 kg/cm$^2$G, in which the yarn is propelled by easily controllable take-up means other than the jet air as utilized in the conventional method, thereby enabling ready and accurate adjustment of the processing speed, draft force, and draw ratio of the yarn.

The above object of the present invention is achieved by an apparatus for producing a yarn from a thermoplastic polymer according to the present invention. The apparatus includes means for extruding a molten polymer through a spinneret as a filament yarn into a spinning tube disposed directly beneath the spinneret, the interior of the spinning tube being kept at a higher pressure than that of the outer atmosphere, means for quenching the filament yarn to solidify it in the spinning tube, and means for withdrawing the filament yarn from the spinning tube through a yarn exit by a take-up means provided outside of the spinning tube. The yarn exit is substantially sealed against leakage of gas charged in the spinning tube.

The apparatus according to the present invention includes a spinneret and a spinning tube disposed directly beneath the spinneret so as to encircle the spinneret and a yarn path following thereto. The spinning tube is provided, in the upstream zone thereof, with an air inlet conduit for introducing pressurized gas into the interior of the spinning tube, and, in the downstream zone thereof, with a yarn exit substantially sealed against leakage of the gas charged in the spinning tube. The yarn exit includes a tubular member and a plug detachably but fluid-tightly inserted into the tubular member. The inner surface of the tubular member and/or the outer surface of the plug is provided with at least one groove for a yarn path along the axes thereof. Further, outside of the spinning tube, means for withdrawing the filament yarn from the spinning tube is arranged.

BRIEF DESCRIPTION OF THE DRAWINGS

Further objects and advantages of the present invention will be more apparent from the following description with reference to the accompanying drawings illustrating the preferred embodiments of the present invention, wherein.

DESCRIPTION OF THE PREFERRED EMBODIMENTS

Overall Construction of the Apparatus

Figure 1:
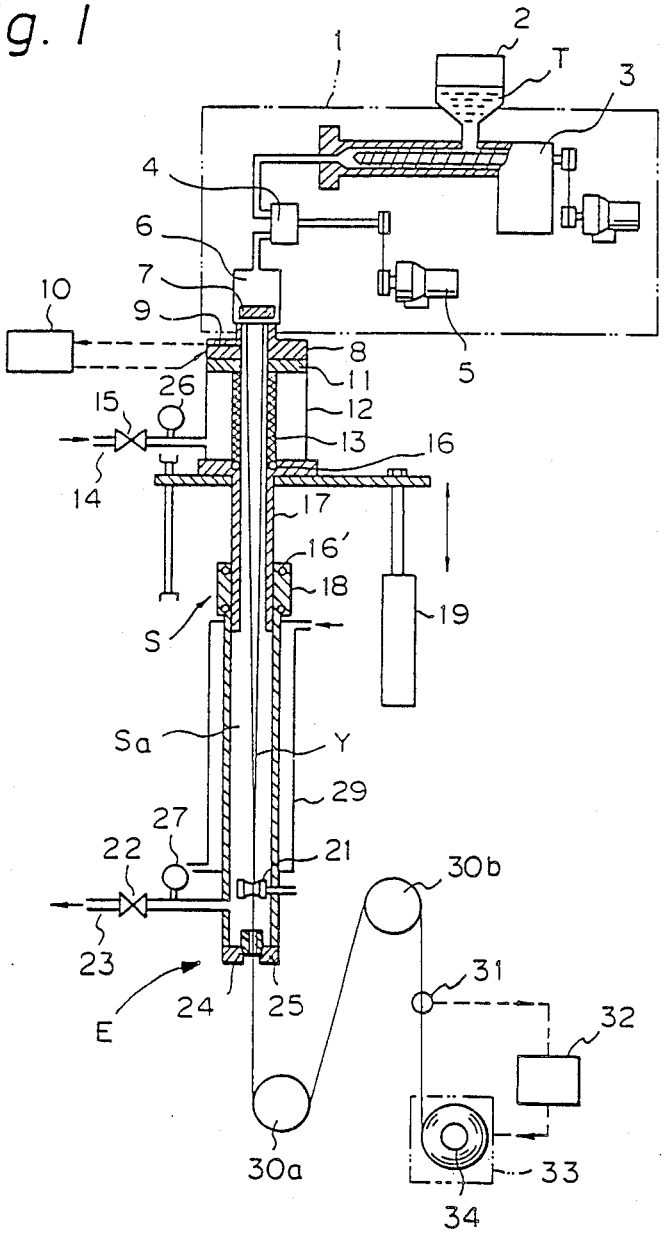
FIG. 1 is a side sectional view of a spinning apparatus according to the present invention.

In FIG. 1, a spinning apparatus according to the present invention includes a melt spinning device 1 including a hopper 2 for accommodating polymer chips T, an extruder 3, a metering pump 4, a variable speed motor 5, a spinning pack 6, and a spinneret 7.

The polymer chips T in the hopper 2 are melted and supplied to the metering pump 4 through the extruder 3. The molten polymer passes through a filter (not shown) in the pack 6 and finally is extruded from the spinneret 7 as a filament yarn Y at a temperature from a melting point Tm of the polymer to (Tm+100)° C. The extrusion rate of the molten polymer from the spinneret 7 can be controlled by the metering pump 4 which, in turn, is controllable by the rotation of the variable speed motor 5.

According to the present invention, there is provided a spinning tube S directly beneath the pack 6 in which the spinneret 7 is secured. The interior of the spinning tube S is maintained at a high pressure by introducing a pressurized gas, usually air therein.

A structure of the spinning tube S will now be described in detail. A heating tube 8, if necessary, may be provided beneath the spinneret 7. Beneath the heating tube 8 is secured, via an insulating member 11 an annular chimney 12 for introducing pressurized quenching air into the spinning tube S. The heating tube 8 is effective when a high viscosity molten polymer is spun for the production of industrial material, but may be eliminated when a low viscosity molten polymer is extruded for the production of clothing material. The heating tube 8 is provided with a thermopile 9 for detecting the temperature within the heating tube 8. The thermopile 9 is connected to a temperature controller 10 so that the temperature within the heating tube 8 can be maintained at a preset value by means of a heater (not shown) built in the heating tube 8. In the usual spinning condition, the temperature of the heating tube 8 is maintained within a range of from (Tm−40) to (Tm+100)° C., wherein Tm stands for a melting point of the polymer treated, and the length thereof is within a range of from 5 to 100 cm.

The annular chimney 12 has a cylindrical porous filter 13 which uniformly distributes pressurized quenching air fed from an air inlet conduit 14 through the entire circumference thereof. The air inlet conduit 14 has a flow regulator 15 for adjusting an air flow rate and a pressure gauge 26.

Figure 2:
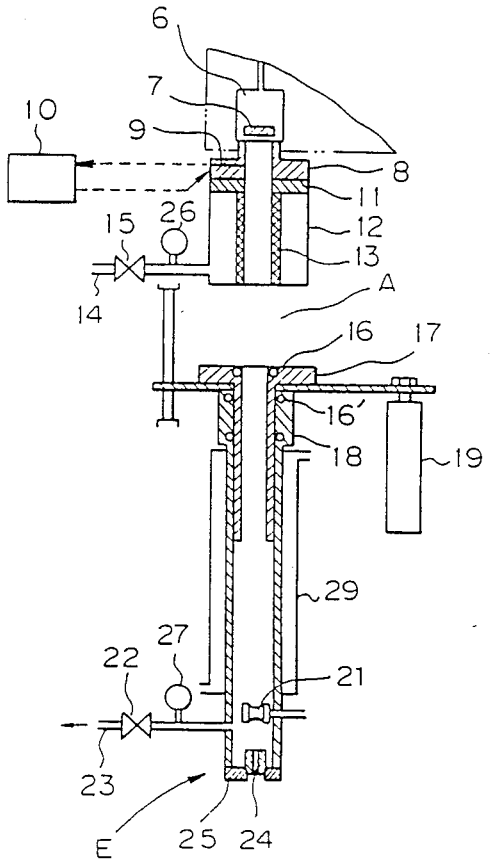
FIG. 2 is a side sectional view of a main part of the spinning apparatus shown in FIG. 1, illustrating a detaching position of a spinning tube.

A main portion of spinning tube S disposed beneath the annular chimney 12 is formed as a double tube including a movable body 17 and a stationary body 18, both of which are telescopically displaceable to each other so that the movable body 17 can be lowered from a first position shown in FIG. 1 to a second position shown in FIG. 2 in the axial direction within the stationary body 18 in accordance with the operation of a power cylinder 19 secured to the former. Namely, in the case of periodic replacement or cleaning of the spinneret 1, correction of yarn breakage, or starting of the spinning, the movable body 17 is lowered to form an access space A for a worker between the bottom of the annular chimney 12 and the top of the movable body 17 (see FIG. 2). For normal spinning, it is lifted up so that the movable body 17 is pressed onto the annular chimney 12 for a fluid-tight seal therebetween. For this fluid-tight seal, there are provided O-rings 16, 16′ in the thrust portion between the movable and stationary bodies 17 and 18 and the contact area between the movable body 17 and the annular chimney 12.

In the embodiment illustrated in FIGS. 1 and 2, the displaceable body 17 can be moved in the axial direction relative to the upper portion of the spinning tube S. This structure is advantageous because even if the displaceable body 17 is detached from the upper portion, the yarn path from the spinneret to the yarn exit is not disturbed thereby and a worker may perform his job while keeping the yarn in a running state. Of course, other directional displacement of the displaceable body 17 can be adopted, for example, to the transverse direction of the yarn path. Further, of the total length of the spinning tube S is short, it need not be formed as two parts 17 and 18, but may be formed as a single displaceable part.

Figure 3A:
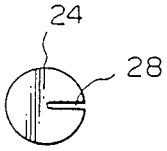
FIGS. 3*a* and 3*b* are top and side views of a plug being set in a tubular member provided at the bottom end of the spinning tube, respectively.
Figure 3C:
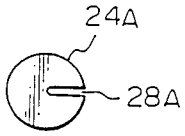
FIGS. 3*c* and 3*d* are top and side views of another embodiment of the plug.
Figure 3B:
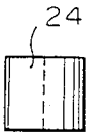
Figure 3D:
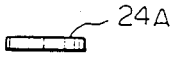

At a lower portion of the stationary body 18 is provided an oiling device 21 in a form of a yarn guide. A yarn exit E, as shown in FIGS. 1 and 2, is provided at the lowermost end of the stationary body 18, which includes, a tubular member 25 and a plug 24 inserted into the tubular member 25 as shown in FIGS. 3*a* and 3*b* or FIGS. 3*c* and 3*d*. A plug 24 having a column-like shape is shown in FIGS. 3*a* and 3*b*, and a plug 24A having a plate-like shape is shown in FIGS. 3*c* and 3*d*. The plug 24 has a slit-like axial groove 28, through which yarn can pass with a small width-wise clearance but through which gas in the spinning tube S is prevented from leaking due to the pressure loss along the groove 28. When the dimensions of the groove 28 are properly selected, the gas in the spinning tube S can be substantially completely sealed in except for that leaking while accompanied by the withdrawn yarn, whereby vibration of the yarn and entanglement of the filaments which often occur when an air flow arises can be avoided. A pressure gauge 27 and an air outlet conduit 23 are provided at the lower portion of the stationary body 18. The conduit 23 is communicated to the outer air through a valve 22.

According to the above structure, a chamber Sa sealed from the outer air and kept at a pressurized state is readily obtainable beneath the spinneret 7 by just pressing the movable body 17 onto the annular chimney 12.

An outer wall of the stationary body 18 is encircled by a heat exchanger 29 through which a cooling medium (not shown) flows, whereby the interior of the sealed chamber Sa can be quenched from the outside. On the other hand, the pressure and flow rate of the quenching air supplied directly into the interior of the sealed chamber Sa can be controlled by the operation of the valve 22 and the valve 15 provided at the inlet portion of annular chimney 12.

The operation of the apparatus will be described below. The molten polymer is extruded from the spinneret 7, as a filament yarn Y, into the sealed chamber Sa and passes through a hot zone provided by the heating tube 8 maintained at a preset temperature by means of the temperature controller 10. Thereafter, the yarn Y is quenched by pressurized gas (usually air) supplied from the annular chimney 12.

The yarn is completely quenched and solidified while it runs through the movable body 17 and the stationary body 18 encircled by the heat exchanger 29. Thereafter, oil is imparted to the yarn Y by means of the oiling device 21. The yarn Y is withdrawn from the sealed chamber Sa through the yarn exit E with the aid of a first godet roller **30*a* and a second godet roller 30*b*, both provided outside of the sealed chamber and rotated at a constant peripheral speed, and, finally, is wound on a bobbin 34 set on a take-up device 33. In this connection, the rotational speed of the bobbin 34 on the take-up device 33 is controlled by a controller 32 so that a winding tension of the yarn Y is kept constant based on a known feed-back control system of the yarn tension detected by a tension detector 31 disposed between the second godet roller 30*b* and the take-up device 34**.

According to the present invention, the interior pressure of the sealed chamber Sa can be maintained at a desired constant value by adjusting the volumes of air supplied into and exhausted from the sealed chamber Sa by means of the valves 15 and 22, respectively, while freely controlling the flow rate of the quenching air flowing along the yarn path in the sealed chamber Sa.

In the above-mentioned embodiment, air is utilized as a pressurized gas charged in the sealed chamber Sa. However, in accordance with the object of the process, other gas, such as nitrogen or steam, may also be utilized. When high molecular orientation of the resultant yarn is solely desired, a gas having a higher density is advantageous. Usually, however, air is sufficient for this purpose. For enhancing the effect of the present invention, the interior pressure of the spinning tube is preferably higher than 1 $kg/cm^2G$.

According to the above embodiment, the yarn Y is taken up on the bobbin 34 after being relaxed in spinning tension by means of the godet rollers **30*a*, 30*b***. However, another take-up system can be adopted, such as a so-called "direct spin-draw" system, in which the yarn is drawn once or twice by a plurality of godet rollers before being taken up.

As for the oiling device, the position thereof is optional, provided the yarn has already been solidified. That is, it may be disposed in the outer air, for example, outside of the yarn exit E. Further, the oil may be applied from the plug 24 when the yarn passes through the groove 28, as described later. Regarding the kind of oiling device, the yarn guide type as shown in FIG. 1 is especially advantageous when the yarn speed is more than 2,000 m/min. However, an oiling roller type may be utilized for relatively low speed spinning.

The heat exchanger 29 is designed to quench the interior atmosphere of the sealed chamber Sa so that the air within the spinning tube S is prevented from rising in temperature by heat transfer from the yarn, such a rise in temperature resulting in a poor quenching effect on the yarn. The heat exchanger 29 is not limited to one in which the quenching medium flows around the outer wall of the stationary body 18 as shown in FIG. 1. Other types, such as cooling pipes, may be adopted for directly quenching the atmosphere in the sealed chamber Sa. Moreover, another annular chimney may be provided in the spinning tube in the vicinity of the yarn exit to supply additional quenching air into the sealed chamber Sa while the flow rate thereof is controlled, so as to maintain the interior pressure at a preset value taking the flow rate from the first chimney into account. If the extrusion rate of the molten polymer is rather low and the elevation of the temperature in the spinning tube is sufficiently suppressed by other quenching means than the additional chimney, the latter may be closed.

Similarly, the heat exchanger 29 and/or the valve 22 for facilitating flow of the quenching air supplied from the chimney 12 may be eliminated if the spinning conditions allow it. This is also applicable to the heating tube 8, which is designed to equalize the viscosity of the molten polymer extruded from each spinning hole of the spinneret 7.

The yarn produced from the above apparatus has a high degree of molecular orientation. This is because the yarn must pass through the spinning tube against the resistance of an atmosphere of increased density due to high pressure, whereby the spinning tension is increased relative to conventional spinning. In addition, it is presumed that heat transfer from the yarn surface to the atmosphere may be improved by the increased density of the gas, whereby the molecular orientation of the yarn is enhanced due to the rapid quenching effect on the heated yarn.

Structure of Yarn-Exit

Next, various types of yarn exits according to the present invention will be described, with reference to the drawings.

Figure 5:
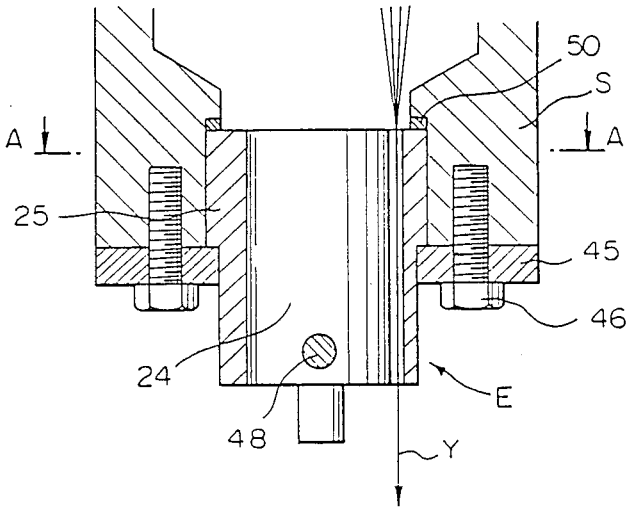
FIG. 5 is a side sectional view of an embodiment of a yarn exit of the spinning tube.
Figure 6:
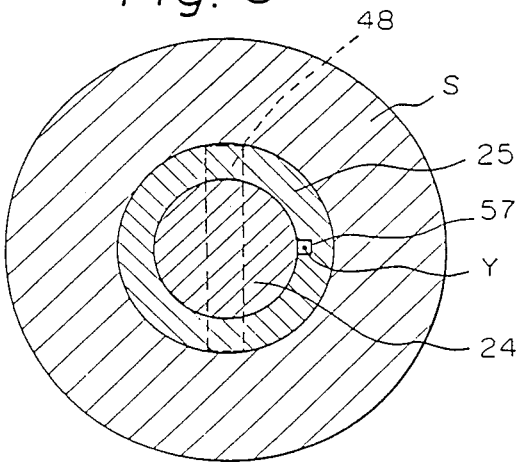
FIG. 6 is a section of the yarn exit shown in FIG. 5 along line A—A.

FIGS. 5 and 6 illustrate a first embodiment of the yarn exit E. To the lowermost end of a spinning tube S, a tubular member 25 is detachably secured by means of a flange 45 and bolts 46. A plug 24 is inserted into the tubular member 25 and detachably secured thereto by means of a pin 48. The tubular member 25 has a longitudinal groove 57 on an inner wall thereof so that a yarn Y can pass therethrough. The yarn Y is withdrawn from the interior of the spinning tube S through the groove 57 and is guided to a take-up means (not shown) via a yarn guide 49.

Fit tolerances between the tubular member 25 and the spinning tube S and between the tubular member 25 and the plug 24 should be as small as possible in order to minimize gas leakage from the interior of the spinning tube S, provided removal of the plug 24 from the tubular member 25 or that of the tubular member 25 from the spinning tube S is possible. If necessary, a gasket 50 may be placed between the spinning tube S and the tubular member 25 for tighter sealing therebetween.

The tubular member 25 and the plug 24 are preferably of a circular cross-section. However, other configurations may be adopted, such as a square. Also, the cross-sectional configuration of the groove 57 may be rectangular, triangular, half-oval, U-shape, and so on.

The width and depth of the groove 57 should be set 35 in accordance with the thickness of the yarn and/or the interior pressure of the spinning tube. Generally, it is preferably that the depth of the groove be larger than the width thereof for avoiding hitching of the yarn between the fitting surfaces of the tubular member 25 and the plug 24.

Figure 7:
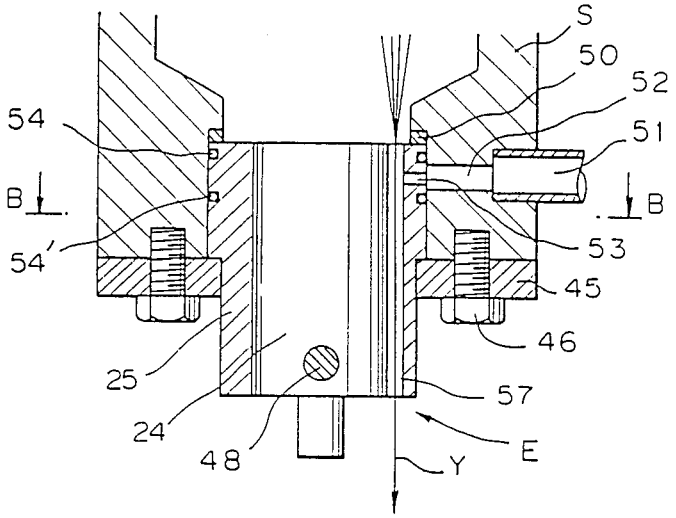
FIG. 7 is a side sectional view of another embodiment of the yarn exit of the spinning tube;.

The inner surface of the groove 57 is finished so as to protect the yarn even if it touches the groove surface. For enhancing this yarn protecting effect, the yarn exit E may be provided with oiling means, as shown in FIG. 7. That is, oil is supplied from a pipe 51 secured to the lower portion of the spinning tube S into the groove 57 through a hole 52 and an orifice 53 of the tubular member 25 communicating to the groove 57. O-rings 54, 54' may be arranged on the outer wall of the tubular member 25 for sealing the oil supplied to the groove 57 from leakage. According to this oiling means, a usual oiling device such as one shown in FIG. 1 and referred to as 21 may be eliminated. Since the orifice 53 is opened directly on the wall of the groove 57, the oil can effectively be imparted to the running yarn Y. Thereby, frictional resistance between the wall of the groove and the yarn decreases and also coherency of the filaments composing the yarn can be improved, which results in stable running of the yarn.

Figure 8:
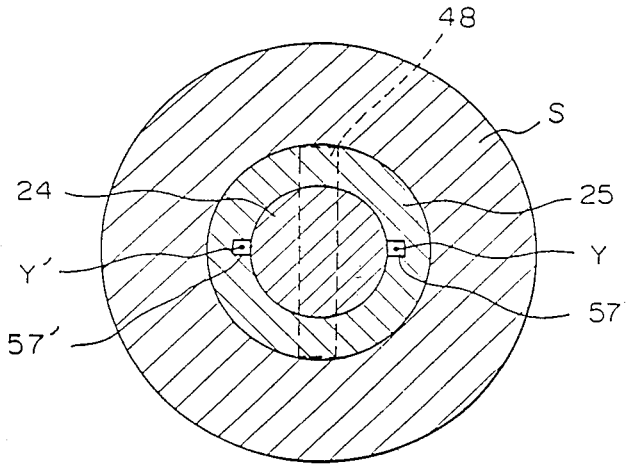
FIG. 8 is a section of the yarn exit shown in FIG. 7 along line B—B.

In the case of a multiple-yarn spinning apparatus, in which multifilaments spun from a single spinneret are divided into a plurality of yarns, each of which is individually withdrawn from the spinning tube, the yarn exit according to the present invention may be used by changing the tubular member to one having a plurality of grooves 57', each corresponding to respective divided yarns. This is shown in FIG. 8, illustrating processing of two yarns Y and Y'.

In order to ensure the desired sealing effect of the yarn exit, according to the study of the present inventors, the cross-section of the grooves 57 is preferably not more than 4.0 $mm^2$ per individual groove more preferably not more than 0.7 $mm^2$. Further, the length of the grooves should be within a range of from 2 to 50 mm. If the length is less than the lower limit, the sealing effect of the groove becomes poor. On the other hand, if longer than the upper limit, the resistance of the groove wall against the running yarn becomes significant, whereby the yarn tends to break.

Threading Operation to Yarn Exit

Figure 4:
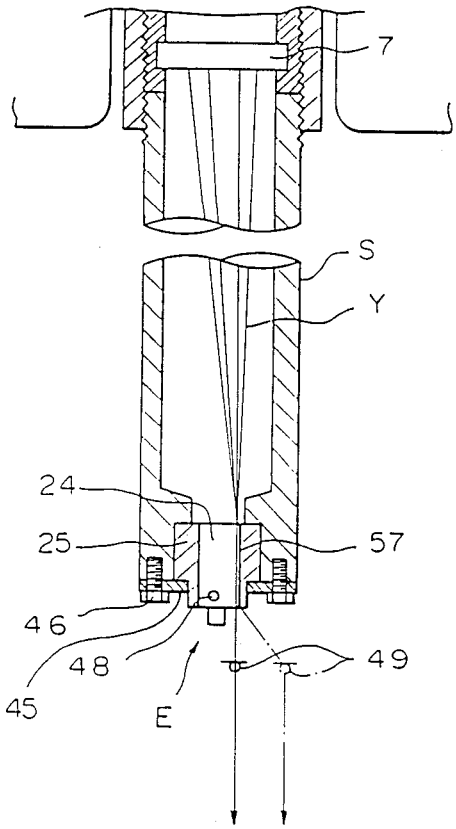
FIG. 4 is a side sectional view of a main part of the spinning tube, illustrating a threading operation through a groove.

The threading operation to the yarn exit will be described with reference to FIG. 4.

After releasing the charged gas in the spinning tube S to the outside atmosphere, the plug 24 is removed from the tubular member 25 by pulling out the pin 48 to form an opening at the yarn exit E. The yarn Y being continuously extruded from a spinneret 7 is withdrawn through the opening and sucked in an aspirator (not shown). According to the present invention, since the wide opening can be formed during the threading operation, yarn waste, which tends to deposit in the spinning tube, can easily be cleaned, The yarn Y is threaded to a yarn guide 49 and guided so as to run along the groove 57, while being sucked in the aspirator. The plug 24 is fit to the tubular member 25 so as to close the opening and fixedly secured thereto by the pin 48. Thereafter, the gas is charged in the spinning tube S to a predetermined pressure and the yarn is transferred from the aspirator to take-up means (not shown) in the conventional manner. Thus, the threading operation is completed.

The essential point of the above operation resides in the fitting of the plug 24 to the tubular member 25. It is important to preliminary guide the yarn Y into the groove 57 by means of the yearn guide 49 prior to the fitting of the plug 24. Otherwise, some of the filament composing the yarn tends to be caught between the plug 24 and the tubular member during the fitting operation. In this regard, the yarn guide 49 is preferably movable between two positions as shown in FIG. 4. Namely, prior to the fitting operation of the plug 24, the yarn guide 49 is retracted to a first position as indicated by a chain line where the yarn Y is forcibly deflected from its normal yarn path so as to completely enter into the groove 57 and, after the fitting operation is over, returns to a second position, a normal position, as indicated by a solid line.

Figure 9:
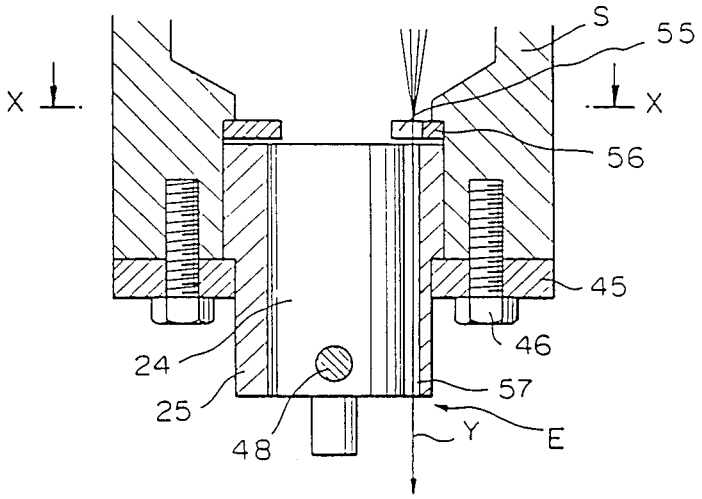
FIG. 9 is a side sectional view of further embodiment of the yarn exit of the spinning tube.
Figure 10:
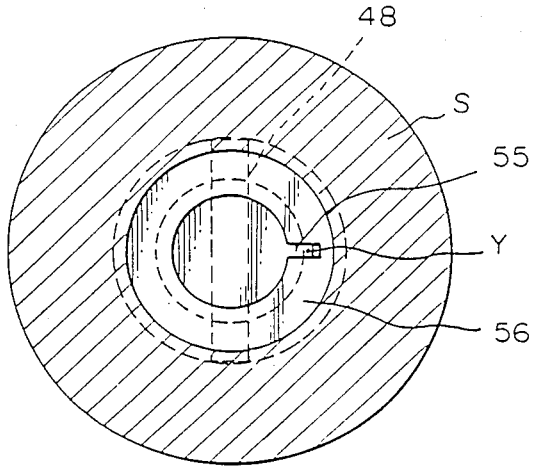
FIG. 10 is a section of the yarn exit shown in FIG. 9 along line X—X.

Further, as shown in FIGS. 9 and 10, a yarn collector 56 may be provided upstream of the tubular member 25 on the axis of the groove 57. The collector 56 has a slit 55 having substantially the same width as that of the groove 57. Therefore, the filaments of the yarn Y are prevented from spreading out by passing through the slit 55 prior to introduction to the groove 57, which facilitates the fitting operation of the plug 24 and decreases the possibility of hitching of the yarn as well as the abrasion of the yarn by the end portion of the groove 57. The shape of the yarn collector 56 is not limited to a slit type as shown in FIGS. 9 and 10, but may be any type, such as a pig-tail, provided the threading operation is readily carried out.

Figure 11A:
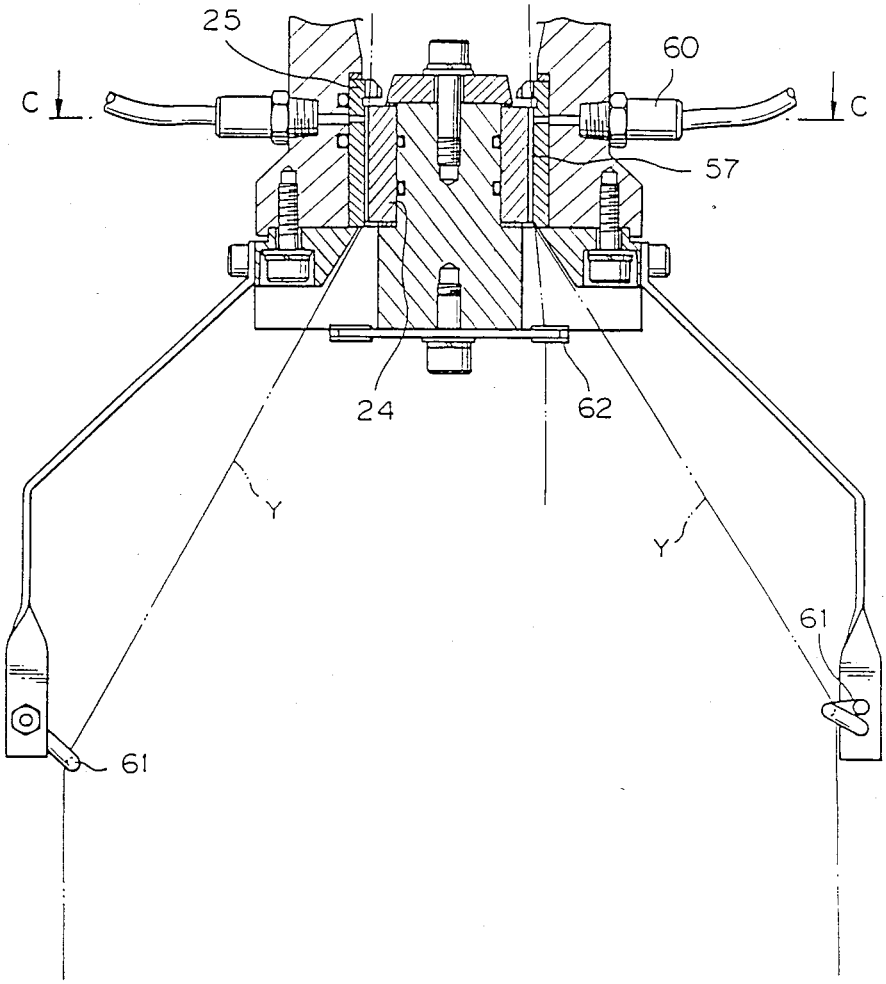
FIGS. 11*a* and 11*b* illustrate a side sectional view and a section along line C—C of the former, respectively, of a still further embodiment of the yarn exit of the spinning tube.
Figure 11B:
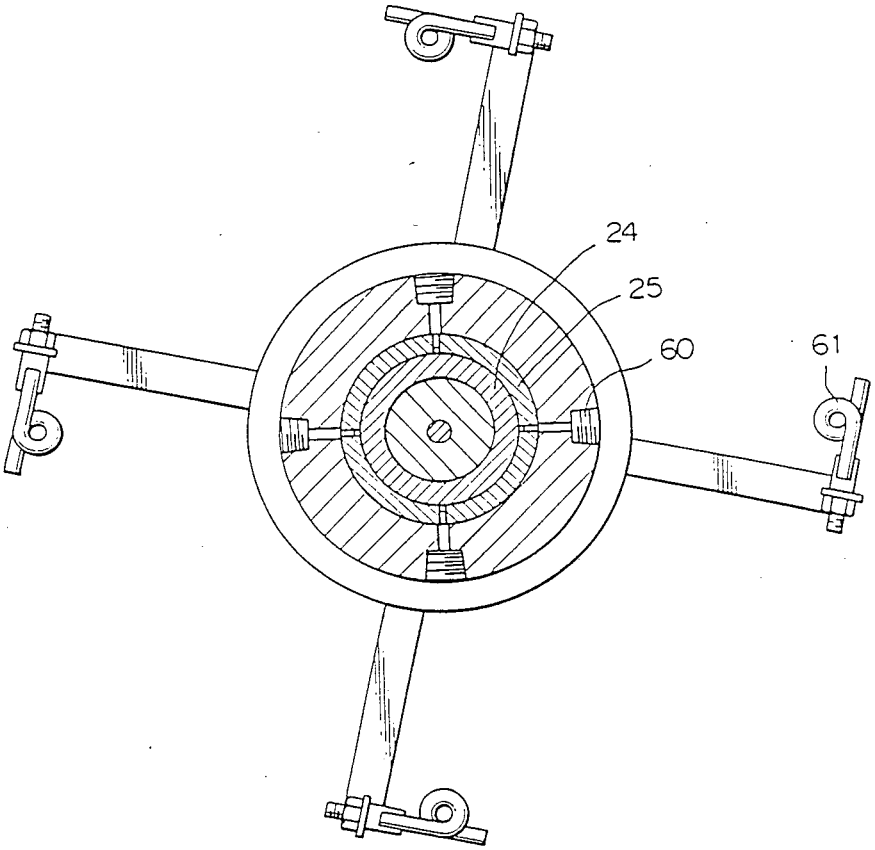

In FIGS. 11*a* and 11*b*, a further embodiment of the yarn exit is illustrated. This embodiment is essentially identical to that shown in FIG. 7, except that four yarns are simultaneously processed. Oil is imparted to each yarn Y by means of respective oiling means 60 while the yarn passes through a groove 57. In this embodiment, the yarn Y rests on a first yarn guide 61 during the threading operation and then returns to a second yarn guide 62 stationarily arranged on the yarn path after the completion of the threading operation.

Figure 14:
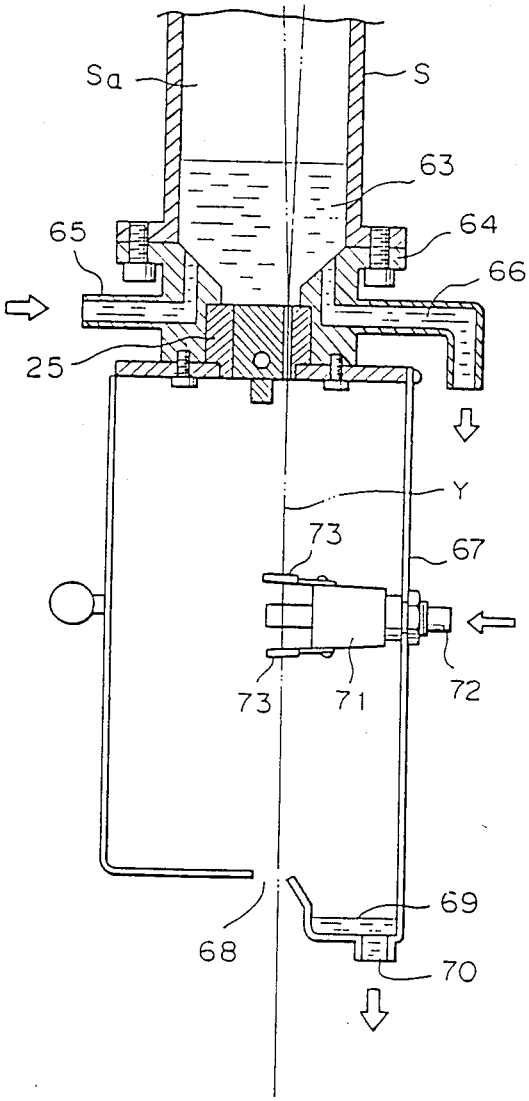
FIG. 14 is a side sectional view of another embodiment of a spinning apparatus according to the present invention.

The apparatus according to the present invention may be utilized such that liquid, such as water or liquid containing yarn treating agent, is further charged in the bottom portion of the spinning tube and the yarn is withdrawn from the yarn exit after passing through the charged liquid as shown in FIG. 14. Due to the larger quenching capacity and resistance against yarn travel o liquid compared tog as, rapid quenching and steady drawing can be obtained. In addition, by varying the height of the charged liquid or the kind of the charged liquid in the bottom portion of the spring tube, the quenching efficiency and the drawing ratio can be easily controlled. This is especially preferable when a thicker yarn is desired.

FIG. 14 illustrates a side sectional view of another embodiment of a spinning apparatus according to the present invention. The apparatus shown in FIG. 14 is only different at around the structure of the bottom portion of the spinning tube of the apparatus shown in FIGS. 1 and 2. In FIG. 14, a bed element 64 is provided at the bottom of the spinning tube S. The bed element 64 has inner opening into which the tubular member 25 is inserted. To the tubular member 25, the plug 24 is inserted. The bed element 64 has a conduit 65 for feeding water and a conduit 66 for exhausting water. A water layer 63 is formed at the bottom portion of the spinning tube S. And further a cover box is provided at the bottom of the bed element 64. At the bottom of the cover box 67, a yarn outlet 68 is formed and a concave portion 69 for receiving water is formed. An exhaust pipe 70 of water is connected to the concave portion 69. In the cover box 67, an air jet nozzle 71 is provided to remove water adhered to the yarn Y. Yarn guide 73, 73 are positioned at both side of the air jet nozzle 71 and a compressed air supply pipe 72 is connected to the air nozzle 71.

Polymer Usable for the Invention

Thermoplastic polymers usable for the present invention are those which can form a fiber under usual melt-spinning conditions, for example, polyamide, such as poly-ε-capramide, polyhexamethylene adipamide, polyhexamethylene sebacamide, polytetramethylene adipamide, polyhexamethylene terephthalamide, polyhexamethylene isophthalamide, polydodecamethylene dodecamide, polymetaxylylene adipamide, polyparaxylylene adipamide, poly-11-aminoundecanoic acid; polyester, such as polyethylene terephthalate, polytetramethylene terephthalate, polyethylene 1,2-diphenoxyethane PP'-dicarboxylate, polynaphthalene terephthalate; polyolefin, such as polyethylene, polypropylene, polybutene-1; polyfluorovinylidene; polyfluoroethylene-polyfluorovinyliden copolymer; polyvinyl chloride; polyvinylidene chloride; and polyacetal. These polymers may be utilized independently or in the form of a copolymer or mixed polymer.

Method for Producing Polyamide Yarn

Now, features of the present invention when applied to production of a polyamide yarn will be described.

Since the quenching effect is superior to that of the conventional method, according to the present invention, a polyamide fiber having less spherulites therein and, thus, having excellent mechanical properties is obtained. The spinning temperature is preferably within a range of from (Tm+20) to (Tm+100)° C., wherein Tm stands for the melting point of polyamide.

The extrusion rate of the spinneret, which, in the prior art, is limited to 3.0 g/min per spinning hole due to generation of spherulites, can be increased.

The gas charged in the spinning tube may be air, nitrogen, and steam, but air is convenient for this purpose. The interior pressure of the spinning tube must be more than 1.0 kg/cm$^2$G, especially more than 1.5 kg/cm$^2$G for suppressing generation of the spherulites.

The polyamide fiber obtained by the present invention has less spherulites in addition to a high molecular orientation, already described. Therefore, the fiber is of high birefringence, high strength, and low elongation. Moreover, since the dimensional stability and durability can be improved by drawing, usage for sportswear and for industrial purposes, especially for tirecords, are expected.

EXAMPLE 1

Polyhexamethylene adipamide having a viscosity of 3.2 relative to sulfuric acid was melt-spun by means of the apparatus shown in FIG. 1. The above polyamide did not contain a delusterant but had 100 ppm of copper acetate and 0.1 weight % of potassium iodide as an antioxidant.

The diameter of the extruder was 30 mm and the spinning temperature of the polymer in the pack was 295° C. The spinneret had an outer diameter of 100 mm and was provided with 24 holes, each having 0.3 mm diameter, arranged in a double ring manner. The extrusion rate of the polymer per hole was 3.0 g/min.

The heating tube had a length of 150 mm and an inner diameter of 150 mm. The temperature thereof was controlled so that a point a distance of 75 mm from the upper part and 10 mm from an outer filament was maintained at 240° C. The annular chimney had a length of 200 mm and an inner diameter of 150 mm and was insulated from the heating tube by an insulating plate of 20 mm width. Quenching air of 25° C. temperature was blown into the chimney to adjust the spinning tube, having a length of 5 m and an inner diameter of 150 mm, to a predetermined interior pressure.

Various runs were carried out under different yarn take-up speeds of 1000, 3000, and 4500 m/min, and levels of interior pressure of 0.7, 1.5, 5.0, and 7.5 kg/cm$^2$G.

Further, for comparison, instead of the spinning tube, as a conventional apparatus, a punched duct of 1 m length provided with a plurality of holes on the circumference thereof, the total area of the holes being 60%, was mounted beneath the chimney and a normal duct of 4 m length was attached thereto so that the air supplied from the upstream side could smoothly flow down through the normal duct and be exhausted from the lowermost end thereof. Air of 25° C. temperature was supplied from the chimney at a rate of 1.5 Nm$^3$/min. Characteristics of various samples obtained from the runs were measured and listed in Table 1.

The test methods were as follows:

1. Breakage strength and elongation

Measurement was conducted according to Japan Industrial Standard (JIS) L1017 (1979). That is, a sample yarn was relaxed in a hank form by being left stationary for 24 hours under conditions of 20° C. and 65% RH. Thereafter, measurement was carried out by means of a "Tension" UTM-4 type elongation tester supplied by Toyo-Baldwin K.K., Japan. For an undrawn yarn, the test length was 5 cm and the elongation rate was 10 cm/min. For a drawn yarn, the test length was 25 cm and the elongation rate was 30 cm/min.

2. Birefringence (Δn)

Measurement was conducted according to the Bereck compensator method by means of a polarizing microscope supplied by Nippon Kagaku K.K., Japan.

3. Transparency

Transparency was determined by examination by the naked eye.

4. Generation of spherulites

This was observed by a polarizing microscope.

As apparent from Table 1, when the interior pressure of the spinning tube is 1 kg/cm$^2$G or less (run Nos. 1 to 6), the resultant fiber has many spherulites and is poor in transparency. Contrary to this, when the interior pressure is more than 1 kg/cm$^2$G (run Nos. 7 to 15), the resultant fiber is excellent in transparency as well as mechanical properties.

TABLE 1

| Run No. | Interior pressure of spinning tube (kg/cm²G) | Take-up speed (m/min) | Yarn thickness (d) | Strength (g/d) | Elongation (%) | Birefringence (× 10⁻³) | Trans-parency*1 | Generation of spherulites*2 |
|---|---|---|---|---|---|---|---|---|
| 1 | normal (0) | 1000 | 567 | 1.69 | 310 | 16.8 | xx | xx |
| 2 | | 3000 | 253 | 2.92 | 141 | 37.2 | xx | xx |
| 3 | | 4500 | 123 | 3.22 | 78 | 44.0 | xx | xx |
| 4 | 0.7 | 1000 | 565 | 1.73 | 298 | 17.2 | xx | xx |
| 5 | | 3000 | 252 | 3.02 | 137 | 38.0 | x | xx |
| 6 | | 4500 | 122 | 3.51 | 74 | 44.5 | Δ | xx |
| ⑦ *3 | 1.5 | 1000 | 569 | 1.92 | 271 | 21.2 | o | Δ |
| ⑧ | | 3000 | 251 | 3.43 | 120 | 39.5 | o | Δ |
| ⑨ | | 4500 | 123 | 4.20 | 65 | 48.0 | o | Δ |
| ⑩ | 4.0 | 1000 | 566 | 2.10 | 265 | 22.6 | o | Δ |
| ⑪ | | 3000 | 254 | 3.72 | 112 | 39.7 | o | Δ |
| ⑫ | | 4500 | 121 | 4.41 | 63 | 48.2 | o | o |
| ⑬ | 7.5 | 1000 | 567 | 2.21 | 255 | 23.3 | o | Δ |
| ⑭ | | 3000 | 253 | 3.82 | 106 | 40.1 | o | o |
| ⑮ | | 4500 | 124 | 4.52 | 60 | 48.8 | o | o |

Note:
*1Mark xx stands for "opaline", xx for "devitrificating", Δ for "somewhat devitrificating", and o for "transparency".
*2Mark xx stands for "significantly conspicious", x for "conspicious", Δ for "somewhat conspicious", and o for "substantially none".
*3Circled runs represent the present invention. Noncircled runs are comparative examples.

EXAMPLE 2

Sample yarns obtained by Run Nos. 3, 5, 8, 11, and 14 were further subjected to two-step drawing as stated below:

The yarn was at first drawn between a feed roller heated at 80° C. and a first draw roller heated at 110° C. and then was further drawn between the first draw roller and a second draw roller heated at 230° C. with the aid of a hot plate of 50 cm length heated at 235° C. disposed therebetween. The draw ratio between the feed roller and the first draw roller was changed to various levels, while the draw ratio between the first draw roller and the second draw roller was kept constant at 1.4, so that the total draw ratio varied as shown in Table 2. By this, the elongation of the yarn was adjusted to be within a range of from 15% to 17%. Thereafter, the yarn was relaxed 5% between the second draw roller and a tension adjusting roller of normal temperature and was wound on a bobbin at a rate of 400 m/min.

The mechanical properties of the drawn yarns are also listed in Table 2.

TABLE 2

| Run No. | Draw ratio | Yarn thickness (d) | Strength (g/d) | Elongation (%) | Remarks |
|---|---|---|---|---|---|
| 3 | 2.13 | 118 | 7.55 | 15.4 | Comparative example |
| 5 | 2.10 | 122 | 7.78 | 15.9 | |
| 8 | 2.04 | 125 | 8.62 | 16.4 | Present invention |
| 11 | 2.03 | 126 | 9.03 | 16.3 | |
| 14 | 2.01 | 128 | 8.82 | 16.6 | |

As apparent from Table 2, the yarn obtained by the present invention becomes extremely strong by proper drawing.

EXAMPLE 3

Poly-ε-capramide having a viscosity of 2.62 relative to sulfuric acid and containing titanium oxide of 3.2 weight % was melt-spun by the same apparatus as utilized in Example 1 with the interior pressure of the spinning tube kept at 4.0 kg/cm²G (run No. 16). The spinning temperature was 265° C., the extrusion rate per hole was 1.25 g/min, and the take-up speed was 4,000 m/min. Further, a finishing agent was applied in the form of an aqueous emulsion to the yarn before the yarn was wound on a package. As a comparative example, normal pressure spinning was carried out as in the case of Example 1 (run No. 17).

Characteristics of the resultant yarns are listed in Table 3.

TABLE 3

| Run No. | Interior pressure of spinning tube (kg/cm²·G) | Yarn Thick-ness (d) | Strength (g/d) | Elonga-tion (%) | Young's modulus (g/d) |
|---|---|---|---|---|---|
| 16 | 4 | 70 | 5.2 | 49 | 25 |
| 17 | 0 | 70 | 4.7 | 62 | 17 |

As apparent from Table 3, according to the present invention, a polyamide yarn having a higher molecular orientation is obtainable relative to the conventional method even with the same take-up speeds.

Method for Producing Polyester Yarn Features of the present invention when applied to production of a polyester yarn will now be described. For obtaining a highly oriented polyester yarn, it is important that the polyester polymer be extruded from the spinneret, as a filament yarn, into a sealed spinning tube, the interior of which is kept at a higher pressure than the outside atmosphere, i.e., preferably more than 1.0 kg/cm$^2$ and, when the yarn is quenched to a temperature in a range of Tg to (Tg-30)° C., wherein Tg stands for a glass transition temperature, the yarn is withdrawn out from the interior of the spinning tube to the outside atmosphere. If the yarn-withdrawing operation is carried out when the yarn temperature is still higher than Tg, the pressurized atmosphere cannot fully influence the molecular orientation of the fiber. On the other hand, if the yarn travels in the pressurized atmosphere even after quenched lower than (Tm-30)° C., the yarn having been 5 properly drawn is stretched again due to the resistance of the pressurized atmosphere, which causes irregular attenuation or filament breakage because the yarn has already been solidified.

EXAMPLE 4

Polyethylene terephthalate chips having an intrinsic viscosity [$\eta$] of 0.63 and a glass transition temperature Tg of 79° C. were melt-spun at a spinning temperature of 295° C. by means of the same apparatus as shown in FIG. 1 except for the elimination of the heating tube. The spinneret was provided with 24 spinning holes, each having a diameter of 0.3 mm. Between the spinneret and the annular chimney was mounted an insulating tube of 100 mm length. The annular chimney had a length of 200 mm and an inner diameter of 150 mm. The sealed spinning tube had a length of 150 mm length and an inner diameter of 150 mm and the interior thereof was charged at a pressure of 4.0 kg/cm$^2$G by quenching air of 25° C. supplied from the annular chimney.

The polyester polymer was extruded from the spinneret at a rate of 33.4 g/min and was withdrawn from the spinning tube at a rate of 4000 m/min. The yarn temperature at the yarn exit was 65° C.

The characteristics of the resultant yarn (run 18) and the comparative yarn obtained by utilization of a conventional spinning tube (run 19) are listed in Table 4.

As apparent from Table 4, the yarn according to the present invention presents higher strength and lower elongation as well as higher degree of molecular orientation relative to the conventional one.

TABLE 4

| Run No. | Interior pressure of spinning tube (kg/cm$^2$·G) | Yarn thickness (d) | Strength (g/d) | Elongation (%) | Birefringence ($\times 10^{-3}$) |
|---|---|---|---|---|---|
| 18 | 4 | 77.2 | 3.4 | 85 | 75 |
| 19 | 0 | 77.5 | 3.0 | 110 | 60 |

EXAMPLE 5

Spinning tests were carried out under the same conditions as run No. 18 of Example 4, except that the length of the spinning tube was varied to inspect the quenching effect. Characteristics of the resultant yarn are listed in Table 5.

TABLE 5

| Run No. | Yarn temperature at yarn exit (°C.) | Strength (g/d) | Range of 24 values of birefringence ($\times 10^{-3}$) | Spinning stability |
|---|---|---|---|---|
| 20 | 100 | 3.1 | 58 to 61 (uniform) | Good |
| 21 *3 | 75 | 3.4 | 74 to 76 (uniform) | Good |
| 22 | 65 | 3.4 | 75 to 76 (uniform) | Good |
| 23 | 50 | 3.5 | 73 to 75 (uniform) | Good |
| 24 | 40 | 3.7 | 68 to 98 (irregular) | Poor*1 |
| 25 | 25 | 3.7 | 70 to 105 (irregular) | Poor*2 |

Note:
*1Some filament breakage.
*2Considerable filament breakage.
*3Circled runs represent the present invention, and uncircled ones the comparative examples.

As apparent from Table 5, in run No. 20, the pressurized atmosphere had almost no effect because the yarn was withdrawn before properly quenched and, therefore, the yarn characteristics were substantially the same as those of run No. 19 of Example 4 (the conventional method). On the other hand, in run Nos. 24 and 25, variance of birefrigence of the resultant yarn was large and generation of fluffs and/or yarn breakage was conspicious during the spinning operation. Run Nos. 21 and 23 according to the present invention gave satisfactory results.

Method for Producing Yarn Composed of Non-Circular Cross Sectional Fibers

Figure 12:
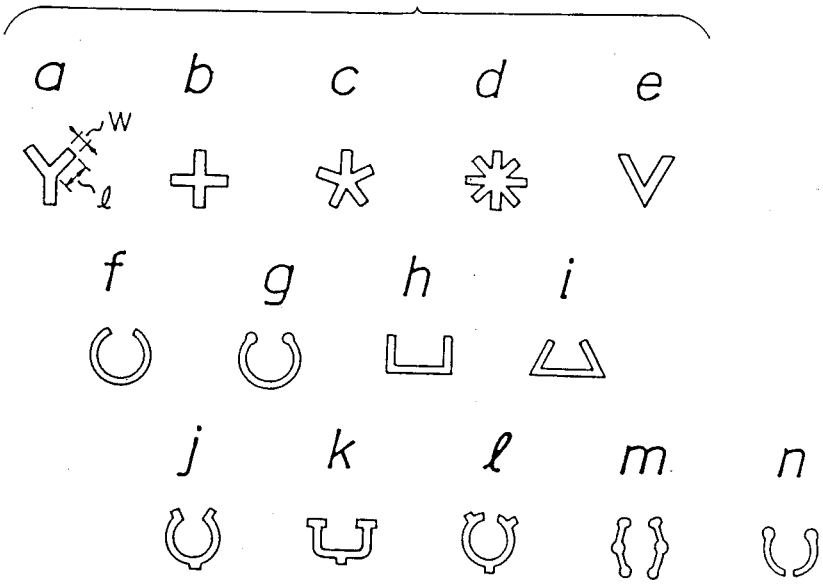
FIGS. 12*a* through 12*n* illustrate various cross-sections of a spinning hole of a spinneret utilized for producing a fiber having non-circular cross-sections.
Figure 13:
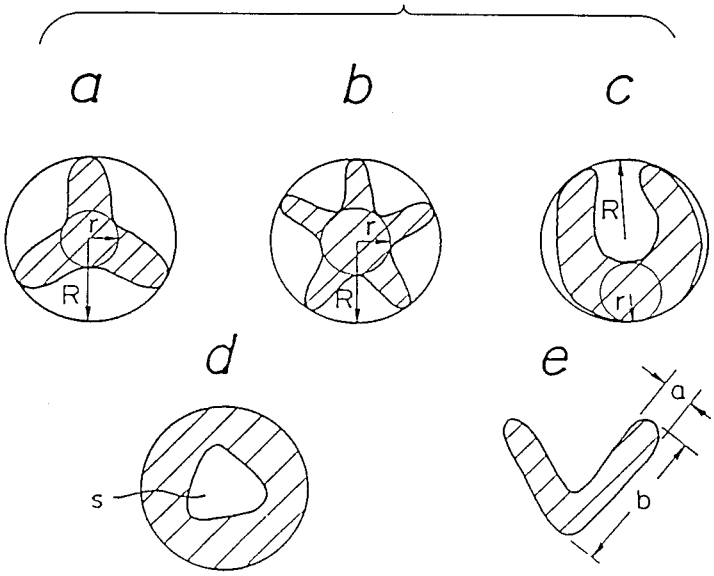
FIGS. 13*a* through 13*e* illustrate typical cross-sections of non-circular cross-sectional fibers.

The present invention can be suitably utilized for spinning a yarn composed of non-circular cross-sectional fibers. A fiber having a non-circular cross-section is well-known in the art for improving the luster and hand of synthetic fabrics. Such a fiber is produced by extruding molten polymer through a spinning hole as illustrated in FIGS. 12*a* to 12*n*.

Recently, it is desired to increase the deformation degree of the cross-sectional configuration of fibers so as to impart various functions, such as bygroscopicity, anti-flammability, or antistatic ability to the textile product. In general, the deformation degree of the fiber cross-section depends on factors such as the shape of the spinning hole, the properties of the molten polymer (melting point, elastic recovery, or surface tension), or the spinning conditions (extrusion rate, spinning temperature, spinning speed, atmospheric temperature, or quenching speed). In order to maintain stable spinning, the above factors are critical, so it is difficult to obtain a fiber having a largely deformed cross-sectional configuration. For example, if a spinning hole having a largely deformed cross-section is utilized, the area of the hole naturally becomes larger than that of an ordinary one, whereby the back pressure of the spinneret tends to drop, which causes irregular extrusion of the polymer from the, spinning hole and results in increased unevenness of the resultant yarn and/or in yarn breakage. Such a phenomenon is conspicious for low melting viscosity polymers such as polyhexamethylene adipamide. In another method, in order to maintain a deformed configuration on a non-solidified polymer flow extruded from a spinning nozzle, strong quenching air is forcibly applied thereto. However, according to this method, irregular quenching occurs, whereby the mechanical properties of the resultant yarn become degraded and an uneven thickness results. Contrary to this, according to the present invention, as stated before, since the quenching effect is superior to the conventional technique, a fiber of a largely deformed cross-section can be obtained even utilizing a conventional spinning hole having not so large an area and utilizing a low-melting-viscosity polymer such as polyhexamethylene adipamide.

In this specification, the term "deformation degree of the cross-section" is defined as follows: In the case of a multilobal configuration as shown in FIGS. 12*a* and 12*b*, the deformation degree M is defined by R/r wherein r stands for a diameter of the inscribed circle of the section and R stands for a diameter of the circumcircle thereof. In the case of the U-shaped configuration as shown in FIG. 12C M is also defined by R/r', wherein r' stands for a diameter of the inscribed circle for the widest portion of the cross-section. In the case of the doughnut shape as shown in FIG. 12*d*, M is defined by S/(S-s), wherein S stands for the total apparent area of the cross-section and s stands for the area of the hollow space. Further, in the case of the V-shape as shown in FIG. 12*e* M is defined by b/a, wherein a stands for a width of the wall width of the cross-section and b stands for a length thereof.

The effects of the present invention when utilized for production of the non-circular cross-sectional fiber yarn will be clearer from the following examples.

EXAMPLE 6

Polyhexamethylene adipamide having a viscosity of 2.78 relative to sulfuric acid and containing titanium oxide of 0.022 weight % was melt-spun into a spinning tube by means of the apparatus shown in FIG. 1. The spinneret had 17 spinning holes of a Y-shape as shown in FIG. 12*a*, in which the slit width (W) was 0.07 mm, the slit length (l) 1.00, and a deformation degree (l/W) 14.3. The extrusion rate of the polymer was 2.0 g/min per hole, and the take-up speed of the yarn was 4500 m/min. air ob 25° C. temperature was supplied from the annular chimney at a rate of 300 Nl/min and was exhausted from the air outlet conduit so that the interior pressure of the spinning tube was maintained at 1.5 kg/cm$^2$G (run No. 30) or alternatively 5.0 kg/cm$^2$G (run No. 31).

As a comparative test, runs were carried out under the following conditions:

1. The interior pressure of the spinning tube was kept at 0.7 kg/cm$^2$G (run No. 29).

2. The interior pressure of the spinning tube was kept at 5.0 kg/cm$^2$G while the exhaust was stopped (run No. 32).

3. The spinning tube was replaced by a conventional spinning duct having no sealing means, while keeping the supply of the quenching air at a rate of 300 Nl/min (run No. 26).

4. In the conditions of run No. 26, the spinneret was replaced by one with spinning holes with a slit width (W) of 0.07 mm, a slit length (l) of 2.00, and a deformation degree (l/W) of 28.6 (run No. 27).

5. In the conditions of run No. 26, the supply rate of the quenching air was changed to 1500 Nl/min (run No. 28).

Characteristics of the resultant yarns obtained from the runs are listed in Table 6.

As apparent from Table 6, the yarns according to conventional spinning under normal pressure (run No. 26) and under lower pressure less than 1.0 kg/cm$^2$G (run No. 29) had a small deformation degree of the fiber cross-section and inferior mechanical properties. When the deformation degree of the spinning hole was increased (run No. 27) or the supply rate of the quenching air was increased (run No. 28) under the conventional spinning pressure, the deformation degree of the fiber cross-section became larger, but the irregularity of the yarn increased and the mechanical properties thereof were degraded. Contrary to this, according to the present invention, since the spinning was carried out under a pressurized atmosphere of more than 1.0 kg/cm$^2$G, the resultant yarn had a larger deformation degree of fiber cross-section as well as excellent mechanical properties (run Nos. 30, 31). However, even by the spinning operation under a pressurized atmosphere of more than 1.0 kg/cm$^2$G, when the exhaust of the interior atmosphere was stopped (run No. 32), sublimated substances such as monomers or oligomers significantly deposited inside of the spinning tube and the interior temperature of the spinning tube was gradually elevated as the time passed, whereby the spinning operation was interrupted in a short time due to lowering of the quenching capacity.

EXAMPLE 7

Poly-ε-capramide having a viscosity of 2.62 relative to sulfuric acid and containing titanium oxide of 0.3 weight % was melt-spun under the same conditions as each run of Example 6, except that the spinning temperature was changed to 265° C.

The results are listed in Table 7.

The same results were obtained as Example 6.

TABLE 6

| Run No. | Interior pressure of spinning tube (kg/cm$^2$/G) | Supply rate of quenching air (Nl/min) | Deformation degree of spinning hole (l/W) | Yarn characteristics: Yarn thickness (d) | Strength (g/d) | Elongation (%) | Deformation (M value) | Degree (CU %) | Irregularity (U %) | Spinnability |
|---|---|---|---|---|---|---|---|---|---|---|
| 26 | normal | 300 | 14.3 | 70.5 | 3.11 | 49.7 | 1.45 | 1.4 | 0.73 | o |
| 27 | normal | 300 | 28.6 | 70.4 | 2.48 | 44.5 | 1.70 | 1.9 | 1.25 | x (Yarn breakage remarkably occurred.) |
| 28 | normal | 1500 | 14.3 | 70.9 | 2.89 | 42.0 | 1.65 | 2.6 | 1.84 | Δ (Yarn was remarkably vibrated.) |
| 29 | 0.7 | 300 | 14.3 | 70.8 | 3.35 | 47.4 | 1.49 | 1.3 | 0.70 | o |
| 30 | 1.5 | 300 | 14.3 | 71.0 | 4.01 | 43.6 | 1.62 | 1.1 | 0.60 | o |
| 31 | 5.0 | 300 | 14.3 | 70.6 | 4.38 | 40.2 | 1.92 | 1.0 | 0.57 | o |
| 32 | 5.0 | 0 | 14.3 | 70.2 | 4.27 | 41.1 | 1.89 | 1.2 | 0.71 | Δ (Monomer and oligomer |

TABLE 6-continued

| Run No. | Interior pressure of spinning tube (kg/cm²/G) | Supply rate of quenching air (Nl/min) | Deformation degree of spinning hole (l/W) | Yarn characteristics: Yarn thickness (d) | Strength (g/d) | Elongation (%) | Deformation (M value) | Degree (CU %) | Irregularity (U %) | Spinnability |
|---|---|---|---|---|---|---|---|---|---|---|
| | | | | | | | | | | were deposited.) |

Note:
Circled runs represent the present invention.
Noncircled runs are comparative examples.

TABLE 7

| Run No. | Interior pressure of spinning tube (kg/cm²G) | Supply rate of quenching air (Nl/min) | Deformation degree of spinning hole (l/W) | Yarn characteristics: Deformation (M value) | Irregularity (U %) | Spinnability |
|---|---|---|---|---|---|---|
| 33 | normal | 300 | 14.3 | 2.47 | 0.72 | o |
| 34 | normal | 300 | 28.6 | 2.83 | 1.15 | Δ (Fluffs and loosened filament generated.) |
| 35 | normal | 1500 | 14.3 | 2.68 | 1.65 | Δ (Yarn was remarkably vibrated.) |
| 36 | 0.7 | 300 | 14.3 | 2.60 | 0.67 | o |
| 37 | 1.5 | 300 | 14.3 | 2.85 | 0.58 | o |
| 38 | 5.0 | 300 | 14.3 | 3.35 | 0.50 | o |
| 39 | 5.0 | 0 | 14.3 | 3.28 | 0.68 | Δ (Monomer and oligomer were deposited.) |

Note:
Circled runs represent the present invention.
Noncircled runs are comparative examples.

We claim:

1. An apparatus for producing a yarn from a thermoplastic polymer, comprising a spinneret, a spinning tube disposed downstream of said spinneret and positioned to encircle said spinneret and the yarn path downstream of said spinneret, said spinning tube having an upstream zone and a downstream zone and being provided, in the upstream zone thereof, with a gas inlet conduit connected to a pressurized gas source for introducing pressurized gas into the interior of said spinning tube, and being provided, in the downstream zone thereof, with a yarn exit substantially sealed against leakage of said pressurized gas charged in said spinning tube, thereby providing a pressurizing means for pressurizing the interior of said spinning tube, said pressurizing means having capacity to maintain a pressure of at least 1 Kg/cm² above atmospheric pressure, said yarn exit comprising a tubular member and a plug detachably inserted in a fluid-tight manner into said tubular member, and said yarn exit being provided with at least one groove providing for a yarn path arranged along the downstream direction, and withdrawing means disposed outside of said spinning tube for withdrawing the filament yarn in a downstream direction from said spinning tube.

2. The apparatus defined by claim 1 wherein said spinning tube further comprises an annular chimney encircling the yarn path, into which chimney said inlet conduit for introducing pressurized gas is opened.

3. The apparatus defined by claim 1, wherein said inlet conduit is provided with a flow regulator.

4. The apparatus defined by claim 1, wherein said spinning tube further comprises an outlet conduit for exhausting pressurized gas from the interior of said spinning tube in the vicinity of said yarn exit.

5. The apparatus defined by claim 4, wherein said outlet conduit is provided with a flow regulator.

6. The apparatus defined by claim 1, wherein said groove has a cross-section of not more than 4.0 mm².

7. The apparatus defined by claim 6, wherein said groove has a cross-section of not more than 0.7 mm².

8. The apparatus defined by claim 1, wherein a plurality of grooves are provided.

9. The apparatus defined by claim 6, wherein the length of said groove is within the range of from 2 to 50 mm.

10. The apparatus defined by claim 1, wherein said spinning tube further comprises oiling means directly upstream of said yarn exit.

11. The apparatus defined by claim 1, wherein said spinning tube further comprises oiling means and an oil feeding pipe which is opened to said groove.

12. The apparatus defined by claim 1, wherein said spinneret has at least one spinning hole having a noncircular cross-section.

13. The apparatus defined by claim 1, wherein at least part of said spinning tube is detachably secured to the remaining part of said spinning tube secured to said spinneret so that said part is displaceable from said remaining part.

14. The apparatus defined by claim 1, wherein said yarn withdrawing means is a godet roller.

* * * * *